United States Patent [19]

Floyd

[11] 4,251,271

[45] Feb. 17, 1981

[54] SUBMERGED INJECTION OF GAS INTO LIQUID-PYROMETALLURGICAL BATH

[75] Inventor: John M. Floyd, Glen Waverley, Australia

[73] Assignee: Commonwealth Scientific and Industrial Research Organization, Campbell, Australia

[21] Appl. No.: 901,513

[22] Filed: May 1, 1978

[30] Foreign Application Priority Data

May 9, 1977 [AU] Australia ..... PD0041

[51] Int. Cl.[3] ..... C22B 15/00; C22B 25/00

[52] U.S. Cl. ..... 75/73; 75/76; 75/85; 266/225

[58] Field of Search ..... 75/72, 85, 60, 73, 76; 266/225, 226, 45

[56] References Cited

U.S. PATENT DOCUMENTS

| | | | |
|---|---|---|---|
| 3,131,054 | 4/1964 | Hollweg | 266/225 |
| 3,310,238 | 3/1967 | Bryant et al. | 266/225 |
| 3,427,151 | 2/1969 | Koudelka et al. | 266/225 |
| 3,549,139 | 12/1970 | Marxen | 266/226 |
| 3,634,069 | 1/1972 | Worner | 75/85 |
| 3,752,402 | 8/1973 | Marioneaux | 266/225 |
| 3,843,105 | 10/1974 | Chang | 266/226 |
| 3,876,190 | 4/1975 | Johnstone et al. | 266/225 |
| 3,898,078 | 8/1975 | Huber | 266/225 |
| 3,905,807 | 9/1975 | Floyd | 75/85 |
| 3,932,172 | 1/1976 | Knüppel et al. | 75/60 |
| 3,945,820 | 3/1976 | Brotzmann et al. | 266/225 |
| 4,052,044 | 10/1977 | Colling et al. | 266/225 |

FOREIGN PATENT DOCUMENTS

| | | | |
|---|---|---|---|
| 1307179 | 2/1973 | United Kingdom . | |
| 1366824 | 9/1974 | United Kingdom . | |
| 452599 | 5/1975 | U.S.S.R. | 266/225 |
| 500239 | 5/1976 | U.S.S.R. | 266/225 |

*Primary Examiner*—L. Dewayne Rutledge
*Assistant Examiner*—Peter K. Skiff

[57] ABSTRACT

A method of injecting gas into a pyrometallurgical bath is disclosed, wherein the gas is injected through a lance having an interior duct for flow of gas therethrough and a discharge end at which the gas is discharged characterized by the steps of presenting the discharge end of the lance to a molten mass of slag and forcing gas through the lance to splash-coat the discharge end of the lance with molten slag and inserting the thus coated discharge end of the lance into the pyrometallurgical bath. Also disclosed is a lance for submerged injection of gas into a liquid pyrometallurgical bath comprising a duct for flow of gas longitudinally through the lance characterized in that the outer wall of the duct is defined by an elongate tube constituting an outer wall of the lance and there is gas flow swirler means within the tube to impart swirl to gas passed through the duct.

8 Claims, 2 Drawing Figures

SUBMERGED INJECTION OF GAS INTO LIQUID-PYROMETALLURGICAL BATH

Figure 1:
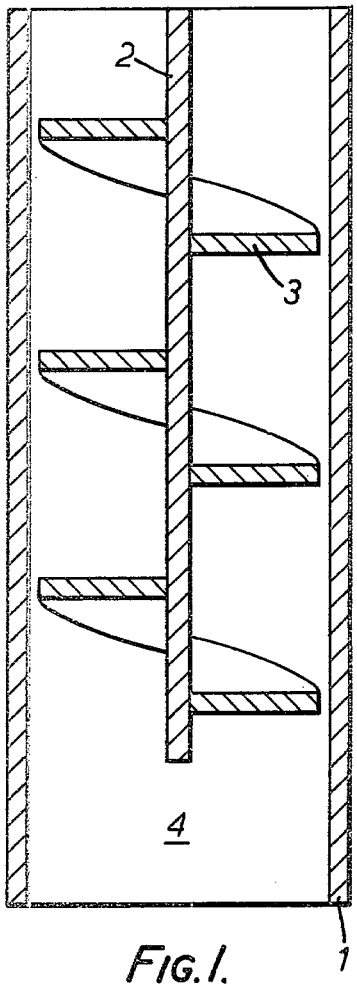

This invention provides a novel method and means for submerged injection of gas into a liquid pyro-metallurgical bath. It has particular but not exclusive application to smelting of copper, nickel, zinc, lead and tin, in the matte fuming of tin, in the refining of copper and in the cleaning of copper and tin slags.

In a conventional copper recovery process, the converting operation in the smelting of sulphide concentrates involves the injection of air into a liquid bath of metallurgical matte to produce iron oxides, which are fluxed with silica to produce a liquid slag, and $SO_2$ which is given off in the evolved gases. The conventional equipment for carrying out this operation is a cylindrical, refractory lined reactor with tuyeres through the side for injection of air. To stop the blowing operation the vessel is rotated about a horizontal axis to bring the tuyeres above the matte and slag levels. The slag and matte are also poured from the vessel by rotation about the horizontal axis. The operation is essentially a batch process involving the intermittent production of $SO_2$-rich gases, making recovery of $So_2$ problematical unless a large number of converting units are used.

Co-pending Australian Application No. PC 6974/76 describes a recently developed process for fuming tin from sulphide ores which involves the injection of air into a matte bath while adding ore to carry out smelting of the ore to produce slag, $SO_2$-rich gases, and tin fume which is caught in a baghouse. This operation may also be carried out in a semi-batch operation in a converter but this also entails intermittent $SO_2$ generation with resultant problems in recovery.

The present invention, by which it is possible to inject gas into a liquid pyro-metallurgical bath either alone or together with heating fuel and/or smelting material, enables both of the above described processes to be carried out continuously in one or more reactors and so allow for continuous generation of $SO_2$—rich gas.

The invention involves the use of a lance by which it is possible to achieve submerged injection of gas into a liquid pyro-metallurgical bath and which may also include provision for the injection of fuel and/or smelting material.

According to the invention there is provided a lance for submerged injection of gas into a liquid pyro-metallurgical bath comprising an elongate tube defining an outer wall of the lance and of a duct for flow of gas longitudinally through the lance, and gas flow swirler means within the tube to impart swirl to gas passed through the duct.

Said tube may be constructed of steel. More specifically it is preferably made of stainless steel and has a wall thickness of less than 2 mm.

The swirler means may comprise one or more spiral gas flow guide members fixed relative to the tube. Such swirler means may be disposed about an elongate member extending longitudinally within the tube and may be connected either to the tube or to the elongate member or to both.

The lance may be designed for injection of gas only, typically an oxidizing gas such as air or a mixture of air and oxygen. In this case the elongate member may be a solid rod or bar disposed within the tube. However, the lance may also include provision for injection of fuel and/or smelting material. In this case the elongate member may be hollow and may encompass one or more passages extending longitudinally of the lance and opening into the discharge end of the lance.

More particularly the elongate member may be a further tube disposed within the outer tube and there may be one or more additional tubes disposed within that further tube to define separate fluid flow passages within it. One of the separate fluid flow passages may terminate at the discharge end of the lance in an atomizing nozzle whereby fuel oil can be passed through that passage to be atomized by said nozzle.

The invention also provides a method of injecting gas into a liquid pyro-metallurgical bath, wherein the gas is injected through a lance having an interior duct for flow of gas therethrough and a discharge end at which the gas is discharged and which comprises the steps of presenting the discharge end of the lance to a molten mass of slag and forcing gas through the lance to splash-coat the discharge end of the lance with molten slag and inserting the thus coated discharge end of the lance into the pyro-metallurgical bath.

Said molten mass of slag may be distributed over the upper surface of the pyro-metallurgical bath. For example, the invention may be applied to a process of smelting sulphide concentrates involving the injection of oxidizing gas into a liquid pyro-metallurgical bath to produce iron oxides which are fluxed with a silica to produce a liquid slag and $SO_2$ and in this case there will be a mass of molten slag formed on the upper surface of the metallurgical bath. This slag may be used to splash-coat the discharge end of the lance prior to insertion into the bath in accordance with the present invention.

In another case a rich slag may be separated from a matte or metal phase and tapped into a separate furnace from a slag bath. This bath of slag may then be treated in a metal-recovery process employing injection of fuel and air through the lance to provide essential heat for the process.

In another aspect the lance of the invention may be used to improve the operation of a stationary bath furnace such as the reverberatory, electric or Outokumpu flash furnace. By inserting the lance through the roof of the furnace it is possible to generate turbulence within the matte, metal and/or slag layer and so enhance heat and mass transfer in the bath and prevent accumulation of deleterious products such as chrome-rich layers of magnetite in the furnace.

In other cases, however, it may be necessary to provide a separate bath of molten slag specifically for the purpose of splash-coating the discharge end of the lance prior to insertion into the pyro-metallurgical bath.

Preferably said duct is bounded by a tube constituting an outer peripheral wall of the lance.

Preferably too, swirling motion is imparted to the gas as it passes through the lance.

Preferably further, the gas reaches superficial velocities of at least 0.35 Mach and maximum velocities approaching 1 Mach in its passage through the lance.

The invention also extends to apparatus for carrying out a metallurgical process, comprising a vessel to hold a liquid pyro-metallurgical bath; a lance for downward insertion into the bath and including an elongate tube defining an outer wall of the lance and of a duct for flow of gas through the lance and swirler means within said duct to impart swirl to gas passed through the duct; and gas delivery means capable of delivering a flow of gas through said duct such that in the vicinity of the swirler means the gas reaches velocities of at least 0.35 Mach, and maximum velocities approaching 1 Mach.

Figure 2:
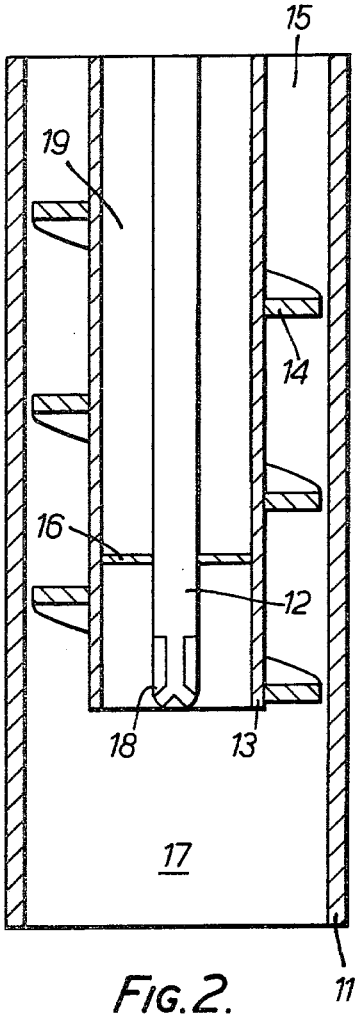

Two particular lance constructions are illustrated in the accompanying drawings, in which:

FIG. 1 shows the essential features of an air injection lance for use in converting operations where no fuel feed is required and coarse flux is dropped into the bath; and FIG. 2 shows the essential features of a lance for submerged injection of air, oil and fine materials for use in converting operations where additional heat is required and fine flux or sulphide concentrate is to be fed down the lance.

The lance illustrated in FIG. 1 comprises an outer tube 1 within which there is disposed a central rod 2 supporting a helically spiralled swirler strip 3. Swirler strip 3 is spiralled closely around central rod 2 and is welded to it and at the upper end of the lance rod 2 is fixed to outer tube 1. The central rod and swirler strip 3 therefore constitute a swirler assembly which is fixed within outer tube 1 and which imparts swirl to gas passed downwardly through the lance. The swirler assembly terminates above the bottom end of outer tube 1 so that an unrestricted chamber 4 is defined within tube 1 at the bottom or discharge end of the lance.

The outer tube 1 is preferably made of a stainless steel such as AISI TP 316. Other steels may be used but this steel provides a good balance between lance cost and lance life. The central rod 2 and swirler strip 3 may be constructed of stainless steel or mild steel and the length and pitch of the swirler can be optimized to provide adequate cooling at the bottom of the lance without undue back-pressure.

In use of the lance air or oxygen-enriched air is passed downwardly through the lance and has swirl and turbulence imparted to it before being discharged from the bottom end of the lance. This oxidizing gas is supplied from a blower of such capacity that the gas reaches velocities approaching 1 Mach in the region of the swirler. As described in more detail below, the lance is operated above a bath of matte before it is inserted into the bath so that a protective layer of slag is formed over the reaction-air cooled outer tube 1. This protective slag layer acts as a thermal insulation and inhibits attack of the steel tube by the matte.

The high air stream velocities within the tube, together with the high degree of turbulence promoted by the swirler and the good heat transfer through the outer tube 1, enables the lance to operate without wear in the corrosive environment.

The swirling motion of oxidizing gases provides conditions for rapid combustion in the bath near the lance tip and also serves to improve the distribution of gas within the metallurgical bath.

For smelting operations where fuel must be provided to make up for heat losses and overall endothermic reactions, the fuel can also be injected through a central tube within the lance. Fine material to be smelted can also be conveyed down the lance with conveyor-air in another tube. A lance suitable for such use is illustrated in FIG. 2.

The lance illustrated in FIG. 2 comprises an outer steel tube 11, a central steel tube 12 mounted concentrically within the outer tube 11 and an intermediate steel tube 13 disposed about the central tube 12 and within tube 11. A spirally wound steel swirler strip 14 is wrapped around intermediate tube 13 and welded to that tube so as to be supported within the annular duct 15 defined between tube 13 and outer tube 11 and so impart swirl to gas passed through that duct. At the upper end of the lance (not shown) intermediate tube 13 is fixed to outer tube 11 and a spacer 16 connects tubes 12 and 13 adjacent their lower ends so that the whole assembly of tube 12, tube 13 and swirler strip 14 is fixed within the outer tube 11. This assembly terminates above the bottom end of the outer tube so that an unrestricted chamber 17 is defined within tube 11 at the bottom or discharge end of the lance.

In use of the lance fuel oil is passed downwardly through central tube 12 and the bottom end of this tube terminates in an oil atomizing nozzle 18 to spray atomized oil into chamber 17. Combustion and oxidation air is passed downwardly through the annular duct 15 between intermediate tube 13 and outer tube 11 and fine powdered material can be passed in a stream of conveying air through the annular passage 19 between the central tube 12 and intermediate tube 13. Tubes 11, 12, and 13 are preferably made of a stainless steel such as an AISI TP 316. As in the previous embodiment, the length and pitch of the swirler can be optimized to provide adequate cooling at the bottom of the lance without undue back-pressure. The design of the swirler can in fact be varied considerably. It can have a single start or a multi-start configuration and may be made of strip material as illustrated or formed from other material such as rod wrapped to appropriate spiral shape. The exact configuration of the swirler will depend on the size of the lance and the flow of oxidizing gas required.

EXAMPLE 1

In one particular trial of a smelting process using a lance constructed in accordance with the invention 30 kg of pyrrhotite concentrate and 10 kg of a converter slag were melted in a rotary furnace and tapped into a pre-heated submerged combustion reactor. The reactor was placed under a flue gas offtake and a lance constructed in accordance with the invention was lowered into the furnace through the flue gas offtake.

The lance comprised an outer stainless steel tube of internal diameter 2.8 cm and a wall thickness of 0.9 mm and an inner mild steel tube supporting a thinner oil tube leading to an atomizing nozzle. A double start swirler of pitch 4 cm and 8 cm long made from 6 mm diameter rod was attached to the bottom of the inner tube. The latter tube had an external diameter of 1.2 cm and terminated 8 cm above the bottom of the lance. The upper end of the lance had a "T" connection and suitable attachments to connect the oil and air supplies.

Initially 122 $m^3 hr^{-1}$ of air and 10 kg $hr^{-1}$ of light oil were injected through the lance and the lance was lowered until the tip was just above the slag layer. In this position slag splashing rapidly produced a solid protective coating of slag on the outer tube. The lance was then lowered through the slag into the matte. A pyritic ore containing tin was dropped into the reactor at a rate of 30 kg $hr^{-1}$ to smelt and oxidize the ore to slag and $SO_2$, giving off the tin as fume for recovery in a baghouse.

The initial temperature was low at 1160° C. and the partly solid and viscous slag produced quite rapid blockage at the end of the lance. When the temperature had been raised to 1210° C. the slag was completely liquid and no further trouble with blockages occurred.

The smelting rate was increased to 60 kg $hr^{-1}$ after 52 minutes and the air rate was increased to 128 $m^3$ $hr^{-1}$ while maintaining the same oil rate of 10 kg $hr^{-1}$.

After a total of 175 minutes of operation, the lance was raised and matte and slag tapped from the reactor at a temperature of 1390° C.

Inspection of the lance after the trial revealed it was not attacked by matte or slag. There was minor surface etching over the last 5 cm of lance of insignificant depth.

EXAMPLE 2

The same equipment used in Example 1 was employed to smelt a pelletized copper concentrate containing 21.3% Cu, 37.9% S and 32.8% Fe.

The starting bath of 40 kg of copper concentrate and 20 kg of converter slag was melted in a rotary furnace and poured into the submerged combustion furnace. The lance, as in Example 1, was lowered until the tip was just above the slag layer whilst air and oil were injected through the lance at rates of 155 $m^3$/h and 12.5 kg/hr respectively. As in Example 1 this produced a protective layer of solidified slag on the outer tube of the lance and the lance was then lowered through the slag into the matte. Pellets containing copper concentrate, cement binder and a siliceous fluxing agent were dropped into the furnace at a rate of 40 kg/hr. After 120 minutes operation slag containing 0.4% Cu and matte containing 40% Cu were tapped from the furnace at a temperature of 1260° C. Inspection of the lance revealed that it was not attacked by matte or slag apart from the minor surface etching previously noted in Example 1.

EXAMPLE 3

In this example the operation of multiple lances in a furnace for tin slag reduction on a larger scale is described.

One tonne batches of first stage tin smelting slag containing approximately 18% Sn, 30% Fe, 30% $SiO_2$ and 7% CaO were transferred from reverberatory smelting furnaces to a submerged combustion furnace. Three lances, two injecting a mixture of oil and air, and one injecting a mixture of fine coal and air, were lowered to just above the slag surface for slag coating before further lowering into the slag bath. After reduction and fuming operations the lances were raised and the slag tapped for discard.

The lances were constructed of AISI TP 316 stainless steel tube. The oil lances possessed outer tubes of 2.81 cm inner-diameter and inner oil tubes of 1.27 cm outer-diameter with a two start, 5.1 cm pitch swirler 5.1 cm in length made from 0.48 cm diameter wire. The coal burning lance possessed an outer tube of 2.27 cm inner-diameter and an inner coal tube of 1.60 cm outer-diameter with a two start, 5.1 cm pitch swirler 5.1 cm in length made from 0.32 cm diameter wire. Typical flows to the oil lances were 30 kg/hr oil, 220 $m^3$/hr air and 6.8 $m^3$/hr oxygen whilst typical flows to the coal lance were 60 kg/hr fine coal carried by 34 $m^3$/hr carrier air, and 150 $m^3$/hr of combustion air.

A series of six trials were performed using this procedure, with or without addition of further lump carbonaceous reductants to the furnace. The total operating time of the lances was 11.75 hours after which no deterioration had occurred.

The particular lances illustrated in the drawings have been advanced by way of example only and the invention is not limited to these constructions nor is it limited to metal recovery processes.

The invention can also be applied to metal refining processes. For example, it may be used for addition of fine copper to a liquid copper bath in a refining furnace. The fine copper may be conveyed through a lance in a stream of air which cools the lance and may also act as an oxidant within the bath. Fuel may simultaneously be injected though the lance to melt the fine copper. In another application of the invention to a refining process, a reducing gas may be injected into a refining bath of copper in place of the normal "poling" operation. In both of these refining applications, it would be necessary to provide a mass of molten slag expressly for the purpose of splash-coating the lance before insertion into the metallurgical bath. The slag could be held in a separate small bath or pot disposed adjacent the upper surface of the main metallurgical bath.

The type of slag used in the method of the present invention may also be varied according to the particular application. A slag rich in copper oxide would be used for oxidation processes in copper smelting and refining operations but in other cases it would be normal to use a silicate slag or in some instances a calcium ferrite slag.

I claim:

1. A method of injection fluid into a liquid pyrometallurgical bath comprising slag or having a slag on its surface, said method comprising the steps of:

(a) passing said fluid through a lance having an interior duct for flow therethrough of said fluid which acts as the sole coolant for the lance, and a discharge end at which the said gas is discharged, (b) lowering said lance to a position at which the discharge end of the lance is adjacent to the surface of the slag whereby said fluid being discharged from said lance causes splashing of said slag, (c) holding said lance in said position whereby splashes of slag deposit on the outer wall of the lance, (d) maintaining a sufficient turbulent subsonic flow unparted by swirling motion of said fluid through said lance to cool said lance to thereby solidify said splashes of slag deposited on said lance to form a protective coating of solid slag, and (e) inserting the discharge end of the thus coated lance into the pyrometallurgical bath.

2. A method as claimed in claim 1, wherein said fluid is air.

3. A method as claimed in claim 2, wherein said air is oxygen enriched.

4. A method as claimed in claims 2 or 3 wherein the bath includes a matte bath beneath said layer of slag formed while smelting tin bearing sulphide ore to produce tin fume, $SO_2$-rich gas and iron oxides which are fluxed with silica to form liquid slag.

5. A method as claimed in claim 1, wherein said fluid reaches velocities approaching 1 mach in its passage through said lance.

6. A method as claimed in claim 2, wherein droplets of liquid are entrained in said air.

7. A method as claimed in claim 2, wherein solid material is entrained in said air.

8. A method as claimed in claims 2 or 3, wherein said lance additionally discharges fuel into said bath.

* * * * *

UNITED STATES PATENT AND TRADEMARK OFFICE

CERTIFICATE OF CORRECTION

PATENT NO. : 4,251,271

DATED : February 17, 1981

INVENTOR(S) : JOHN MILLICE FLOYD

It is certified that error appears in the above-identified patent and that said Letters Patent are hereby corrected as shown below:

IN THE CLAIMS

| | | |
|---|---|---|
| Claim 1, | Line 1 | Please change "injection" to ---injecting---. |
| | Line 7 | Please change "gas" to ---fluid---. |
| | Line 16 | Please change "unparted" to ---imparted---. |

Signed and Sealed this

*Sixteenth* Day of *March 1982*

[SEAL]

*Attest:*

GERALD J. MOSSINGHOFF

*Attesting Officer* *Commissioner of Patents and Trademarks*